United States Patent [19]

Kress

[11] 4,250,658

[45] Feb. 17, 1981

[54] DUCTED FAN FOR MODEL AIRCRAFT

[76] Inventor: Robert W. Kress, 27 Mill Rd., Lloyd Harbor, N.Y. 11746

[21] Appl. No.: 27,767

[22] Filed: Apr. 6, 1979

Related U.S. Application Data

[63] Continuation of Ser. No. 787,761, Apr. 15, 1977, abandoned.

[51] Int. Cl.[3] ..... A63H 27/00

[52] U.S. Cl. ..... 46/76 A; 60/269; 46/1 R

[58] Field of Search ..... 46/76 A, 56, 95, 1 R, 46/74 R; 60/269, 263; 244/73 R, 73 C

[56] References Cited

U.S. PATENT DOCUMENTS

| | | | |
|---|---|---|---|
| 1,957,896 | 5/1934 | Marguglio | 60/269 X |
| 2,304,008 | 12/1942 | Muller | 60/263 |
| 2,396,911 | 3/1946 | Anxionnaz et al. | 244/73 R X |
| 2,547,095 | 4/1951 | Robins | 46/76 A |
| 2,998,700 | 9/1961 | Chaplin, Jr. | 60/269 X |
| 3,968,944 | 7/1976 | Zimmer et al. | 60/269 X |

FOREIGN PATENT DOCUMENTS

| | | | |
|---|---|---|---|
| 2238321 | 2/1975 | France | 46/76 A |

*Primary Examiner*—Louis G. Mancene
*Assistant Examiner*—Mickey Yu

[57] ABSTRACT

A ducted fan engine for model aircraft which is powered by a conventional model piston engine. The engine is mounted in a hollow portion of an inner core body and drives a multibladed fan. Two sets of stationary vanes are attached to the core body and a cylindrical shroud, fitted over the assembly, is attached to the outer ends of the vanes.

5 Claims, 9 Drawing Figures

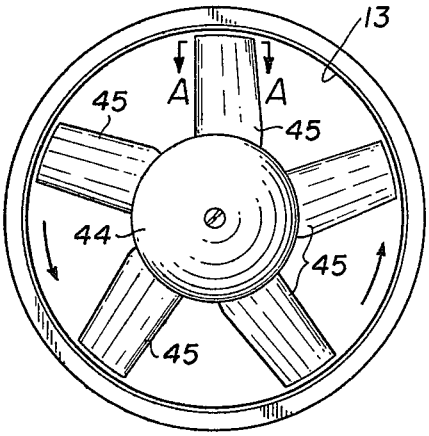
FIG.8
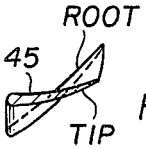
FIG.9
A-A
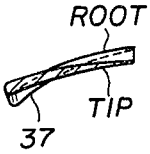
FIG.5
B-B
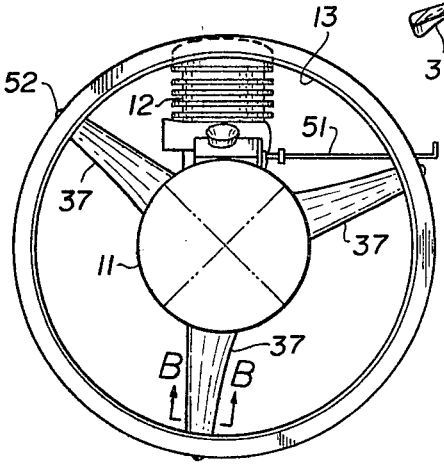
FIG.4
FIG.7
C-C
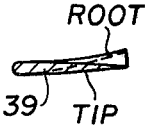
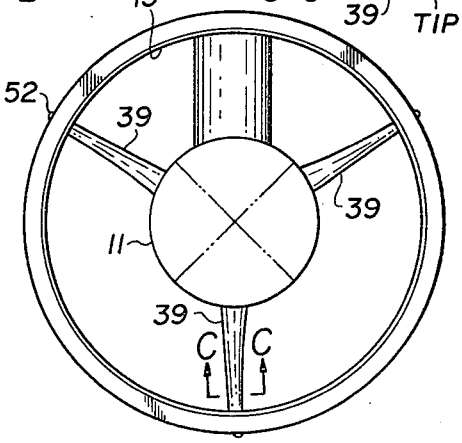
FIG.6

DUCTED FAN FOR MODEL AIRCRAFT

This is a continuation of application Ser. No. 787,761, filed Apr. 15, 1977, now abandoned.

BACKGROUND OF INVENTION

The present invention relates to model aircraft and has particular reference to ducted fan jet propulsion means thereof. There has been a lack of readily available ducted fan units for model aircraft, although piston engines for propeller driven craft are in abundance. The present invention fills this void by providing a device which is driven by the commonly available model aircraft engine yet acts like a fan propulsion unit. The ducted fan engine is specifically designed for easy kit fabrication by the producer and simple construction by the modeler.

SUMMARY OF INVENTION

The entire unit may be assembled by the serious hobbyist from a kit, or may be made available as a preassembled unit. Basically, the device comprises an inner core body having a hollow portion to receive the motor therein and an outer cylindrical shroud surrounding the core, supported from the inner body by a plurality of vanes forward and aft of the motor. There is attached to the shaft of the engine a circular hub member carrying a plurality of fan blades (the rotor) for rotation within the cylindrical shroud. The core body vanes are aerodynamically designed to reduce the swirling action in the air flow generated by the rotor fan blades before exiting from the engine.

BRIEF DESCRIPTION OF THE DRAWINGS

For a more complete description of the invention, reference may be had to the accompanying diagrams in which, FIG. 4 is a head on view of the forward vanes, FIG. 5 is a diagram showing the shape of the vanes in FIG. 4, FIG. 6 is a head on view of the rear vanes, FIG. 7 is a diagram showing the shape of the vanes in FIG. 6, FIG. 8 is a front view of the fan rotor, and FIG. 9 is a diagram illustrating the shape of the fan blade.

DESCRIPTION OF THE PREFERRED EMBODIMENT

Figure 1:
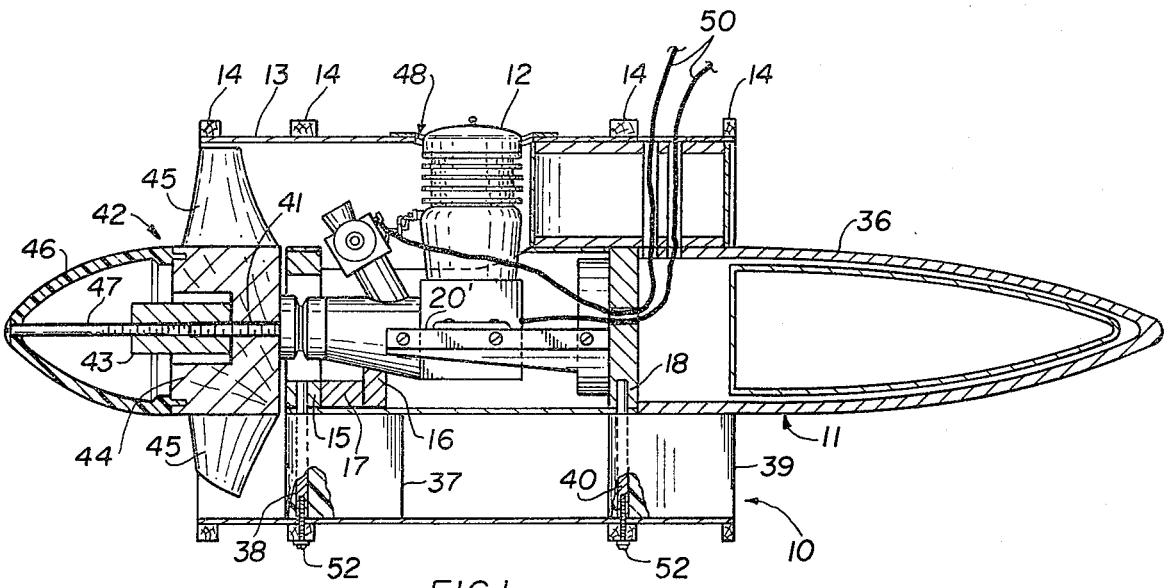
FIG. 1 is a longitudinal cross section of the ducted fan.
Figure 2:
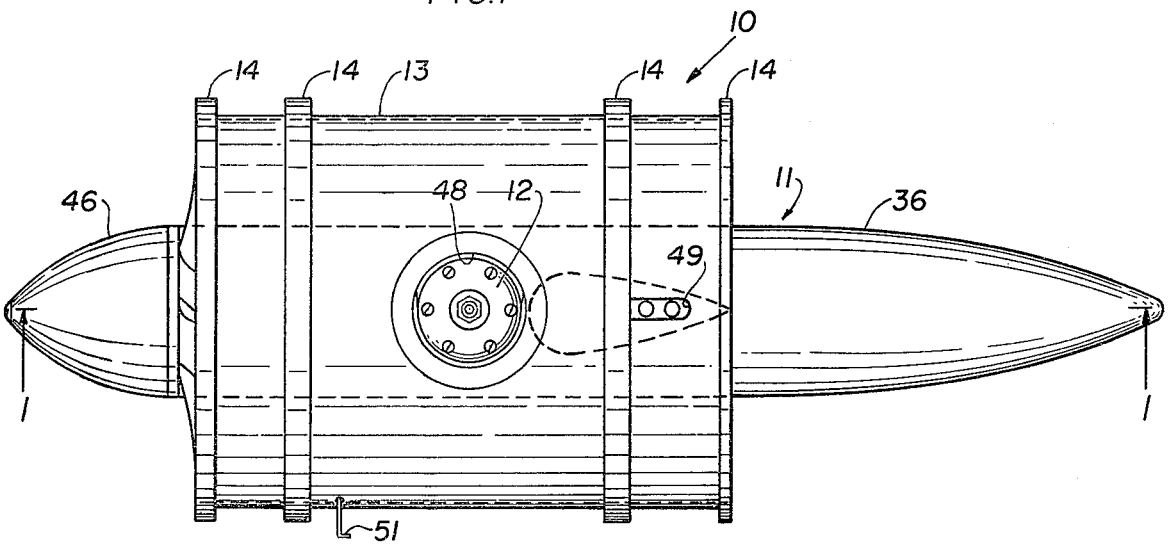
FIG. 2 is a top view of the fan.
Figure 3:
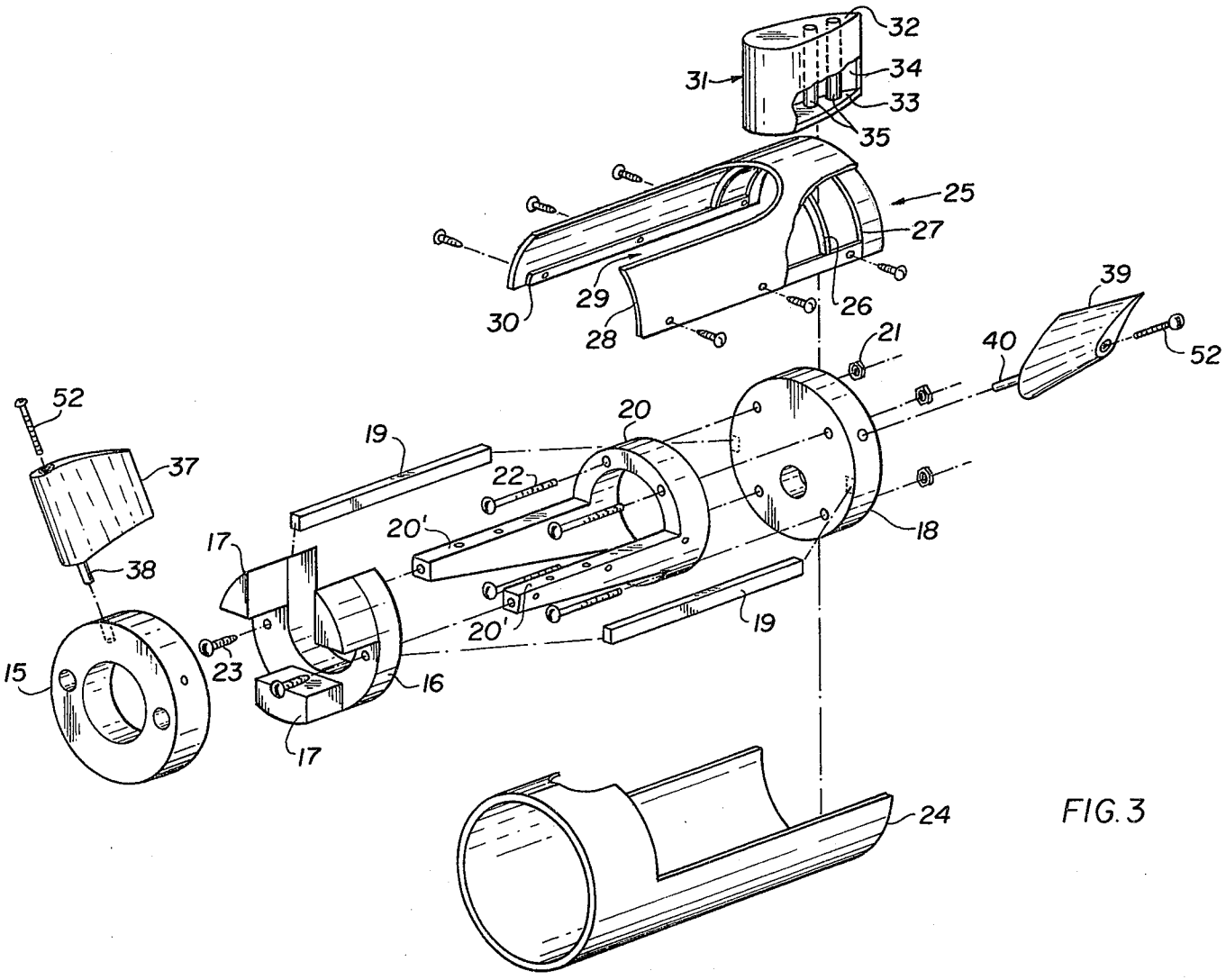
FIG. 3 is an exploded view of central body.

With reference now to FIGS. 1 and 2, a cylindrical shroud 10 surrounds the central body 11 in which a conventional motor 12 is mounted. The shroud 10 is preferably made of thin (1/32") plywood sheet 13, (although plastic sheet may be used) bent into a cylindrical shape, and inserted into the four retaining rings 14 which may also be cut from plywood. In this description plywood and balsa wood are specified because they were readily available, but it should be understood that other materials may be substituted such as one of the plastics for example. The sheet 13 is fastened to the inside of the rings with an appropriate adhesive. The two middle rings may be thicker than the outer rings. The central body may be assembled as seen in FIG. 1 and in the exploded view of FIG. 3. A ring member 15 is attached to a U-shaped member 16 by a plurality of spacers 17 which are glued to each of members 15 and 16. A rear disc like member 18 is attached to the U-shaped member 16 by strips 19 the ends of which are glued to the members 18 and 16. Preferably the members 15 and 18 are made of ½" plywood, the member 16 of ¼" plywood. A motor mount 20 is attached by nuts and bolts 21, 22 to the rear member 18, and by screws 23 to the U-shaped member 16. Access holes in the member 15 are provided for screws 23. The top of the wood strips 19 are below the top of the mounting surfaces 20' of mount 20, for purposes to be described. The skelton structure just described is covered with a thin (1/32") sheet of plywood, 24 except for the portion over the motor mount. The plywood is glued to the members 15, 16, 18 and 19. A removable hatch cover 25, which covers the area left open in the skin, comprises a semi-circular bulkhead 26 and a stiffener 27 to which a sheet of plywood 28 with a cutout portion 29 is glued. Stiffener strips 30 are also glued along the bottom edges of the sheet 28. To the rear of the cutout 29 the cylinder fairing 31 is glued to the top of the hatch cover 25. The fairing 31 comprises two balsa wood layers 32 and 33, covered by thin plywood 34. A pair of tubes 35 extend through the fairing between the balsa layers. The stiffeners 30 are attached to the motor mount arms 20' with screws, the bottom of the stiffeners 30 resting on the top of the strips 19, when assembled (i.e. after the motor has been put in place). To the rear of the member 18 is attached a tail piece 36, which may contain a fuel tank if desired, or may be simply a solid piece of balsa wood. After the central body is covered with the plywood the forward vanes 37, preferably three in number, are attached to the body by means of rods 38 which are adhesively held in holes drilled radially into ring 15 and spaced equally about its circumference. (See FIG. 4 also) The vanes 37 are generally longitudinally positioned and glued to the plywood skin 24. FIG. 5 shows the shape of the vanes 37, looking from tip to root. Similarly, the three rear vanes 39 (see also FIG. 6) are attached by rods 40 and adhesive to holes drilled into the rear member 18 and positioned generally longitudinally and extending over the tail piece 36, to which they also may be glued. The shape of the rear vanes 39 is shown in FIG. 7, looking from tip to root. The vanes 37 and 39 are preferably of molded plastic with the steel inserts or shafts 38 and 40 respectively having threaded holes on the outer ends thereof.

The shaft 41 of the motor 12 extends through the aperture in the ring 15 and the multibladed fan 42 is attached thereto by the long nut 43. The fan 42 comprises a hub portion 44 (See FIGS. 1 and 8) and a plurality of blades 45 thereon. The blades 45 are secured to the hub 43 in skewed grooves and are shaped as shown in FIG. 8, in which the root configuration describes the shape of the groove in the hub's outer surface. The hub 44 and blades 45 may also be a one piece injection molded plastic assembly. A spinner 46 is held against the hub 44 by the long screw 47 which is threaded into the long nut 43.

Over the completed central body is placed the shroud 10, which has an opening 48 therein to accomodate the cylinder and spark plug of the motor 12, and another opening 49 over the tubes 35 through which fuel and oil may be lead to and from the motor through appropriate flexible tubing 50. A further aperture in the skin of the shroud is provided for the control rod 51 to the engine throttle. The shroud is then secured to the threaded holes in the inserts or shafts 38 and 40 by machine screws 52 through the middle rings 14. The ring 14 of the shroud 10 is substantially over the motor blades tips or help contain the motor blades from flying outward if they should happen to break.

Having described the construction of the ducted fan, a kit of parts may be assembled in generally the following steps:

1. Construct the central skeleton from the two rings, U-shaped member (which may also be a ring, however) motor mount, spacers and strips.
2. Cover the bottom half with the plywood skin.
3. Construct the hatch with the engine opening, and cylinder fairing.
4. Assemble the tail piece (or fuel tank) to the skeleton.
5. Attach the two sets of vanes to the frame with glue.
6. Attach motor to motor mount.
7. Cover motor with hatch.
8. Assemble shroud from plywood sheet and four rings.
9. Assemble fan from hub and fan blades and use on one piece fan.
10. Attach fan assembly to motor shaft, and spinner to fan assembly.
11. Slide shroud over entire assembly and secure to vanes, (removing spark plug on cylinder head of motor for clearance). Omitted from the above procedures are the obvious steps of smoothing and painting the various components as they are constructed.

In operation, the multibladed fan drives a volume of air to the rear to create forward thrust upon exiting from the rear of the engine. However, that volume of air leaves the fan motor with a rotational component which, if not removed, would reduce the longitudinal thrust available. The two sets of vanes 37 and 39 are therefore designed to redirect the air, in two steps, so that it will exit from the rear of the engine in a longitudinal direction with no rotational component, thus maximizing the efficiency of the engine.

In the description, the major materials used are balsa wood, thin plywood, and plastic to insure a light weight final product. Various changes can be made in the materials specified without departing from the spirit of the invention as expressed in the appended claims, however. For example, the shroud could be fabricated from plastic sheets and rings as could the rest of the parts in mass production. The entire fan assembly could be one piece moulded plastic or nylon, eliminating the need for assembling the several parts thereof. Similarly, in an advanced state, the entire central core could be moulded of plastic to eliminate the assembling of the various parts which make up the skeleton in the description hereinbefore presented.

Thus, having described only a typical form of the invention, I do not wish to be limited to the specific details set forth herein but wish to reserve to myself any variations or modifications that may appear to those skilled in the art and fall within the scope of the appended claims.

I claim:

1. A device of the character described for operation by a piston driven model aircraft engine to produce a ducted fan propulsion device including:

an inner core body including a forward hollow portion for receiving and mounting said engine therein, a streamlined fairing projecting rearwardly from said hollow portion of said core body, said fairing having diminished cross sectional area away from said hollow portion, a circular member carrying a plurality of fan blades situated forward of said hollow portion and connected for rotation by said engine, a set of forward vanes on said inner core body, said forward vanes being located behind and adjacent to said fan blades, a set of rear vanes mounted on said inner core body, said rear vanes being spaced behind said forward vanes, a cylindrical shroud about the fan blades, the forward vanes and the rear vanes extending from a plane ahead of the fan blades to a plane behind the rear set of vanes, providing an annular duct surrounding said core body and vanes, and said shroud being attached to both said forward and rear vane sets, said fan blades extending radially outward from said inner core body to said circular shroud, whereby rotation of said fan blades at high speed by said engine propels air axially through said annular duct and said vane sets remove the swirl in said axially propelled air, thereby creating a ducted fan jet effect, said inner core body including an inner framework comprising forward, intermediate and rear members at least partially circular, said members being attached together by spacers and longitudinal members respectively, engine mounting means secured to said rear member, a thin flexible sheet covering substantially the entire framework leaving an opening between the intermediate and rear members for receiving the engine in said framework.

2. A device of the character described for operation by a piston driven model aircraft engine to produce a ducted fan propulsion device including:

an inner core body including a forward hollow portion for receiving and mounting said engine therein, a streamlined fairing projecting rearwardly from said hollow portion of said core body, said fairing having diminished cross sectional area away from said hollow portion, a circular member carrying a plurality of fan blades situated forward of said hollow portion and connected for rotation by said engine, a set of forward vanes on said inner core body, said forward vanes being located behind and adjacent to said fan blades, a set of rear vanes mounted on said inner core body, said rear vanes being spaced behind said forward vanes, a cylindrical shroud about the fan blades, the forward vanes and the rear vanes extending from a plane ahead of the fan blades to a place behind the rear set of vanes, providing an annular duct surrounding said core body and vanes, and said shroud being attached to both said forward and rear vane sets, said fan blades extending radially outward from said inner core body to said circular shroud, whereby rotation of said fan blades at high speed by said engine propels air axially through said annular duct and said vane sets remove the swirl in said axially propelled air, thereby creating a ducted fan jet effect, said circular member comprising a relatively thick hub, a plurality of skewed grooves in the periphery of said hub, and moulded fan blades set into each groove.

3. A device of the character described for operation by a piston driven model aircraft engine to produce a ducted fan propulsion device including;

an inner core body including a forward hollow portion for receiving and mounting said engine therein, a streamlined fairing projecting rearwardly from said hollow portion of said core body, said fairing having diminished cross sectional area away from said hollow portion, a circular member carrying a plurality of fan blades situated forward of said hollow portion and connected for rotation by said engine, a set of forward vanes on said inner core body, said forward vanes being located behind and adjacent to said fan blades, a set of rear vanes mounted on said inner core body, said rear vanes being spaced behind said forward vanes, a cylindrical shroud about the fan blades, the forward vanes and the rear vanes extending from a plane ahead of the fan blades to a plane behind the rear set of vanes, providing an annular duct surrounding said core body and vanes, and said shroud being attached to both said forward and rear vane sets, said fan blades extending radially outward from said inner core body to said circular shroud, whereby rotation of said fan blades at high speed by said engine propels air axially through said annular duct and said vane sets remove the swirl in said axially propelled air, thereby creating a ducted fan jet effect, said forward vanes making a greater angle to the longitudinal axis than the rear vanes.

4. A device of the character described for operation by a piston driven model aircraft engine to produce a ducted fan propulsion device including:

an inner core body including a forward hollow portion for receiving and mounting said engine therein, a streamlined fairing projecting rearwardly from said hollow portion of said core body, said fairing having diminished cross sectional area away from said hollow portion, a circular member carrying a plurality of fan blades situated forward of said hollow portion and connected for rotation by said engine, a set of forward vanes on said inner core body, said forward vanes being located behind and adjacent to said fan blades, a set of rear vanes mounted on said inner core body, said rear vanes being spaced behind said forward vanes, a cylindrical shroud about the fan blades, the forward vanes and the rear vanes extending from a plane ahead of the fan blades to a plane behind the rear set of vanes, providing an annular duct surrounding said core body and vanes, said shroud being attached to both said forward and rear vane sets, said fan blades extending radially outward from said inner core body to said circular shroud, whereby rotation of said fan blades at high speed by said engine propels air axially through said annular duct and said vane sets remove the swirl in said axially propelled air, thereby creating a ducted fan jet effect, and wherein the streamlined fairing is hollow and includes a fuel tank.

5. The device of claim 1 wherein the cylindrical shroud comprises a plurality of rings and a thin sheet material secured to the inner circumference of said rings.

* * * * *